United States Patent [19]

Richter et al.

[11] Patent Number: 4,640,691

[45] Date of Patent: Feb. 3, 1987

[54] PAD DYEING PROCESS FOR WOOL

[75] Inventors: Wolfgang Richter, Hofheim am Taunus; Bernd Dürl, Kelkheim, both of Fed. Rep. of Germany

[73] Assignee: Hoechst Aktiengesellschaft, Fed. Rep. of Germany

[21] Appl. No.: 823,468

[22] Filed: Jan. 28, 1986

[30] Foreign Application Priority Data

Jan. 30, 1985 [DE] Fed. Rep. of Germany ..... 3502960

[51] Int. Cl.[4] ..... C09B 62/00; D06P 3/14

[52] U.S. Cl. ..... 8/543; 8/549; 8/917; 8/551

[58] Field of Search ..... 8/543, 549

[56] References Cited

U.S. PATENT DOCUMENTS

| | | | |
|---|---|---|---|
| 2,895,785 | 7/1959 | Alsberg et al. | 8/449 |
| 2,950,165 | 8/1960 | Hadfield et al. | 8/549 |
| 4,264,321 | 4/1981 | von der Eltz | 8/476 |
| 4,304,566 | 12/1981 | von der Eltz et al. | 8/533 |
| 4,560,388 | 12/1985 | Rohrer | 8/543 |
| 4,568,350 | 2/1986 | Rohrer | 8/543 |

*Primary Examiner*—A. Lionel Clingman

*Attorney, Agent, or Firm*—Connolly and Hutz

[57] ABSTRACT

Vinylsulfonyl dyes, if padded from acidic liquors, produce on wool merely dyeings having a poor yield and only moderate fastness properties if the pad-beam method is used. It has been found according to the invention that padding from weakly alkaline liquor (pH 7–9) with sodium bicarbonate as fixing alkali and subsequent batching (6–24 hours) of the material produces good coloristic results especially on wools with a low-felting or non-felting finish.

6 Claims, No Drawings

PAD DYEING PROCESS FOR WOOL

The present invention relates to a pad cold batch process for dyeing wool with reactive dyes.

Cold pad-batch dyeing processes for wool have been long known to the colorist. Therein the textile material is padded with acid, metal complex or reactive dyes from an room temperature for a certain period. In addition to the dyes used for that purpose, the padding liquors used usually contain high amounts (up to 300 g/l) of urea. Under these conditions, reactive dyes, in particular those of the vinylsulfonyl type, are fixed only incompletely and produce reduced fastness properties.

Practical circles have long expressed the wish to be able to offer solid dyeings which match prints with reactive dyes on wool in hue and which were prepared with the same dyes in an inexpensive manner. Apart from simplified stockholding, the background to the demand is probably chiefly the desire to obtain in the case of composé articles agreement with respect to the appearance of the shade in artificial light, which is pivotal in the case of wool articles, not only in the printed but also in the solid-dyed portion of the textile material, which is otherwise not present when different types of dye combinations are used for such patterning purposes. Moreover, matching the shade of the dyeing in line with an existing printing recipe presents much fewer difficulties.

The previously addressed situation thus led to the stated object to develop an inexpensive dyeing method which requires little expense on hardware, namely a pad cold batch method for dyeing wool with reactive dyes, which does not have the abovementioned shortcomings and disadvantages of the state of the art.

This object is achieved according to the invention by padding the fiber material at a pH value between 7 and 9 with aqueous liquors containing the dissolved reactive dyes and then, to fix the dye, batching this dyeing at temperatures of up to 25° C., preferably within the region of room temperature, in the moist state under the established weakly alkaline conditions for 6 to 24 hours, in general 12 to 18 hours.

The fixing alkali used for the reactive dyes in the padding liquors according to the present invention is sodium bicarbonate in amounts of 5 g/l to 40 g/l; preference is given to using 20 g of sodium bicarbonate per liter.

This method of working in an alkaline medium, as it is practiced by the claimed process, was however completely novel to the wool dyer, since according to his previous notions it was likely that such a procedure wherein the textile material is stored for long times to effect fixing would result in damage to the wool by the alkali.

However, experimental studies of these matters have shown, surprisingly, that the degree of damage which is done to the wool does not exceed that which occurs regardless in the other dyeing methods having the stated objectives. On the contrary, the degree of damage is distinctly lower than in conventional processes in which the liquor contains high amounts of urea (up to 300 g/l). By contrast, the process according to the invention dispenses with the use of urea.

It is admittedly true that the fixing of reactive dyes from an alkaline medium by batching was also previously proposed in European Patent Application EP-A1-0,126,026 for the dyeing of silk or silk-containing blended fiber materials. But silk, in particular wild silk, is regarded by those skilled in this field as much less sensitive to alkaline influences than has been assumed for wool. For instance, the degumming of silk is effected by means of alkaline sodium carbonate liquors. For the previously mentioned motives, therefore, the use of alkaline conditions was generally ruled out for the treatment of wool fibers. When measures of this kind were occasionally impossible to dispense with, they were carried out in each case in as short a time as possible and only from ammoniacal baths. Application of the experiences gained with silk to the use on wool was in these circumstances not in any way obvious.

Suitable reactive dyes for carrying out the process according to the invention are all chemical compounds which are mentioned in the Colour Index, 3rd edition 1971 and supplements 1975 under the generic heading "Reactive dyes" and which are capable of entering a covalent bond with OH- and/or NH-containing fibers.

The padding liquors used can contain in addition to the dye other assistants of the customary kind such as wetting agents or assistants for promoting or preventing dye migration, if this should be found to be necessary.

The claimed process is in general carried out as follows:

The wool textile to be dyed is padded at about room temperature with the padding liquor which contains dye, sodium bicarbonate and possibly assistants. The liquor pickup can be between 50 and 130% on weight of dry fiber, depending on the nature of the material to be dyed.

Thereafter, to fix the dyestuff, the moist cloth is batched at about room temperature for 6 to 24 hours, which is customarily effected in the rolled-up state by slowly rotating the beam. Advantageously this measure is carried out with air substantially excluded, which is obtained by wrapping the beamed cloth in a plastic sheet. If the liquor pickup is suitably low, the moist textile material can also be batched in the plaited state. Subsequently the completed dyeing is rinsed, washed and neutralized.

Using the present invention it is possible to produce in this way dyeings having a good color buildup and high fastness properties, even if dyes of the vinylsulfonyl type are used.

Particularly good results can be obtained when dyeing wools with a nonfelting or low-felting finish (for example chlorinated wools or wools finished by application of polyimine or polyacrylic resins).

EXAMPLE 1

A fabric made of wool without an antifelting finish is padded with an aqueous liquor at room temperature (25° C.) which contains per liter 20 g of the dye Reactive Orange 16 having the C.I. No. 17757, 5 g of a wetting agent based on isotridecyl alcohol reacted with 8 moles of ethylene oxide per mole of alcohol and 20 g of sodium bicarbonate.

The liquor pickup is 95% on weight of the dry fiber material. The cloth treated in this way is then beamed in the moist state resulting from squeezing off the excess liquor and to fix the dye is batched at room temperature by slowly rotating the beam for 24 hours.

Thereafter the dyeing thus produced is first rinsed with water at 40° C., to remove dye portions not fixed to the substrate and nonreactive hydroxy dye portions formed by hydrolysts from the vinylsulfonyl dye is washed at 80° C. by treatment with ammonia in an alkaline medium at pH 8.5 for 15 minutes, is rinsed once more with water and is then neutralized with acetic acid.

This gives a brilliant orange dyeing on the wool having very good fastness properties.

Fastness tests before the ammonia aftertreatment have shown that the covalent bond between fiber and dye was formed beforehand during the batching time.

EXAMPLE 2

A wool fabric with a nonfelting finish by application of polyimine resin is padded with a liquor at 20° C. which contains in addition to water per liter as further components 10 g of the dye Reactive Blue 19 having the C.I. No. 61200, 5 g of a wetting agent based on a reaction product of 1 mole of isotridecyl alcohol with 8 moles of ethylene oxide and 20 g of sodium bicarbonate.

The liquor pickup is 85% by weight. This padded fabric is then beamed and to fix the dye the beam is left to rotate slowly at room temperature for 10 hours.

Thereafter the completed dyeing is thoroughly washed at 40° C. with water and is finally neutralized by treatment with acetic acid.

This gives a level, fast brilliant blue dyeing on the wool.

EXAMPLE 3

A wool jersey made of chlorinated wool is dyed as follows:

Padding at room temperature (25° C.) and with a 100% by weight liquor pickup with an aqueous liquor comprising per liter 30 g of the dye Reactive Black 5 having the C.I. No. 20505, 5 g of the wetting agent used in Example 1 and 20 g of sodium bicarbonate.

Thereafter beaming of the moist cloth and batching of same at room temperature on a slowly rotating beam for 20 hours.

The ammoniacal aftertreatment of the dyed wool fibers is effected as in Example 1.

This gives on the textile material a level anthracite dyeing having good fastness properties.

EXAMPLE 4

Fabric made of chlorinated wool is padded with an aqueous liquor of the following composition per liter:

15 g of the dye Reactive Blue 2 having the C.I. No. 61211, 5 g of a nonfoaming, anionic wetting agent mixture and 20 g of sodium bicarbonate.

The padding temperature is 25° C., and the liquor pickup is 100% by weight. After beaming, the padded fabric web is stored at room temperature for 16 hours on a slowly rotating beam and is then finished as described in Example 2.

This gives a level blue dyeing on the fabric.

What is claimed is:

1. A pad cold batch process for dyeing wool with reactive dyes, which comprises padding the fiber material at a pH value between 7 and 9 with aqueous liquors containing the dissolved reactive dyes and then, to fix the dye, batching this padded fiber material in the moist state at temperatures up to at most 25° C., for 6 to 24 hours under the established weakly alkaline conditions.

2. The process as claimed in claim 1, wherein the fixing alkali used in the padding liquors is sodium bicarbonate in amounts of 5 g/l to 40 g/l.

3. The process as claimed in claim 1, wherein the padding liquors contain no urea.

4. The process as claimed in claim 1, wherein the wool dyed has been pretreated by chlorination or has been given a low- or nonfelting finish by application of a polyimine resin or of a polyacrylic resin.

5. The process as claimed in claim 2 wherein said sodium bicarbonate is in amount of 20 g/l.

6. The process as claimed in claim 1, wherein said temperature is within the region of room temperature.

* * * * *